US008365665B2

(12) United States Patent
Risner et al.

(10) Patent No.: US 8,365,665 B2
(45) Date of Patent: Feb. 5, 2013

(54) FIREWORKS IGNITER SYSTEM AND METHOD

(76) Inventors: Andrew Risner, Sarasota, FL (US); Lisa M. Fitzgerald, Sarasota, FL (US)

( * ) Notice: Subject to any disclaimer, the term of this patent is extended or adjusted under 35 U.S.C. 154(b) by 107 days.

(21) Appl. No.: 13/084,137

(22) Filed: Apr. 11, 2011

(65) Prior Publication Data

US 2012/0255455 A1 Oct. 11, 2012

(51) Int. Cl.
*F23Q 7/14* (2006.01)

(52) U.S. Cl. ..... 102/215; 102/304; 102/361

(58) Field of Classification Search ..... 102/200, 102/215, 202.5, 202.9, 202.14, 206, 275.12, 102/304, 361; 361/248, 247; 219/260
See application file for complete search history.

(56) References Cited

U.S. PATENT DOCUMENTS

| | | | | |
|---|---|---|---|---|
| 2,003,483 | A | 6/1935 | Frye | |
| 2,114,176 | A | 4/1938 | Christ | |
| 3,125,025 | A | 3/1964 | Boggs et al. | |
| 3,292,302 | A | 12/1966 | Estes et al. | |
| 3,503,333 | A | 3/1970 | Estes | |
| 3,570,403 | A | 3/1971 | Hawley et al. | |
| 3,662,685 | A | 5/1972 | Lurey | |
| 4,862,802 | A | 9/1989 | Streifer et al. | |
| 5,274,214 | A * | 12/1993 | Blackburn | 219/268 |
| 5,691,500 | A | 11/1997 | Mancini | |
| 6,082,264 | A | 7/2000 | Meyer et al. | |
| 6,874,424 | B2 | 4/2005 | Bailey et al. | |
| 6,966,260 | B1 | 11/2005 | Martinez | |
| 7,237,488 | B2 | 7/2007 | Duescher et al. | |
| 7,682,148 | B2 * | 3/2010 | Mochizuki et al. | 431/153 |
| 7,688,566 | B2 | 3/2010 | Zhang | |
| 7,757,607 | B1 | 7/2010 | Deye | |
| 7,834,295 | B2 * | 11/2010 | Sharma et al. | 219/260 |
| 2003/0070572 | A1 | 4/2003 | Tang | |
| 2004/0020393 | A1 * | 2/2004 | Bailey et al. | 102/202.5 |
| 2006/0060575 | A1 * | 3/2006 | Lindsey et al. | 219/268 |
| 2009/0145321 | A1 * | 6/2009 | Russell | 102/215 |
| 2010/0068154 | A1 * | 3/2010 | Sharma et al. | 424/40 |
| 2010/0083859 | A1 * | 4/2010 | Bossarte et al. | 102/342 |
| 2010/0190121 | A1 * | 7/2010 | Mochizuki et al. | 431/153 |
| 2010/0242770 | A1 | 9/2010 | Deye | |

* cited by examiner

*Primary Examiner* — Bret Hayes
*Assistant Examiner* — Joshua Freeman
(74) *Attorney, Agent, or Firm* — Charles J. Prescott, P.A.

(57) ABSTRACT

A fireworks igniter system and method for safely igniting fuse-type fireworks including a handheld igniter module and a remote control module. An igniter head at the proximal end of the igniter module includes a heater element and fuse clamp slide which receives and biasingly molds the fuse against the heater element. A microprocessor in the igniter module includes an infrared receiver and an igniter module actuator. The remote control module includes an infrared emitter and a remote control module actuator, the infrared emitter emitting a coded IR signal in response to activation of the actuator. The IR signal is sensed by the infrared receiver to activate the igniter module actuator and deliver electric current to the heater element sufficient to ignite the fuse.

12 Claims, 14 Drawing Sheets

FIREWORKS IGNITER SYSTEM AND METHOD

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to the field of fireworks and pyrotechnic igniters, and more particularly to a remotely controlled fireworks igniter for use with consumer-type fireworks.

2. Description of Related Art

Although consumer-type fireworks have been severely regulated and, with respect to those that are legal in most states, have been substantially reduced in explosive and pyrotechnic capacities, nonetheless, legal fireworks which are currently available and illegal fireworks which carry substantially greater charges of explosive material, can be quite dangerous. Particularly with respect to young and adult children, many injuries to the eyes and hands, particularly fingers occur during each yearly fireworks seasons particularly prior to Fourth of July celebrations.

Many of these consumer-type fireworks have very short fuses and are difficult to hand launch a safe distance away. Moreover, all fuses have their own burn rate and erratic and rapid fuse burn can lead to unpleasant surprises and fireworks ignition before anticipated. A number of devices and apparatus have been developed and patented which are intended to substantially enhance the safety factor in setting off fireworks, particularly those for both commercial and consumer use.

Bailey et al. teach remotely controlled igniters for use with consumer class fireworks in U.S. Pat. No. 6,874,424 and U.S. Patent Application Publication 2006/0207467. A fireworks holder with remote control firing system is disclosed by Tang in U.S. Patent Application Publication 2003/0070572. U.S. Pat. No. 5,691,500 to Mancini discloses a remotely-actuated fireworks launcher. Neahr teaches an electric firework igniter in U.S. Pat. No. 1,445,904. A fuse igniter is taught by Frye in U.S. Pat. No. 2,003,483. U.S. Pat. No. 7,688,566 to Zhang discloses an electric firing device for fireworks. U.S. Pat. No. 4,862,802 to Streifer et al. discloses a method for initiating pyrotechnic ignitions in the proper sequence.

The present invention discloses a very safe fireworks igniter system which, when used properly as taught, ensures fuse ignition at a safe distance and manner of ignition.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a fireworks igniter system and method for safely igniting fuse-type fireworks including a handheld igniter module and a remote control module. An igniter head at the proximal end of the igniter module includes a heater element and fuse clamp slide which receives and biasingly molds the fuse against the heater element. A microprocessor in the igniter module includes an infrared receiver and an igniter module actuator. The remote control module includes an infrared emitter and a remote control module actuator, the infrared emitter emitting a coded IR signal in response to activation of the actuator. The IR signal is sensed by the infrared receiver to activate the igniter module actuator and deliver electric current to the heater element sufficient to ignite the fuse.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Exemplary embodiments are illustrated in reference figures of the drawings. It is intended that the embodiments and figures disclosed herein are to be considered to be illustrative rather than limiting.

DETAILED DESCRIPTION OF THE INVENTION

Figure 1:
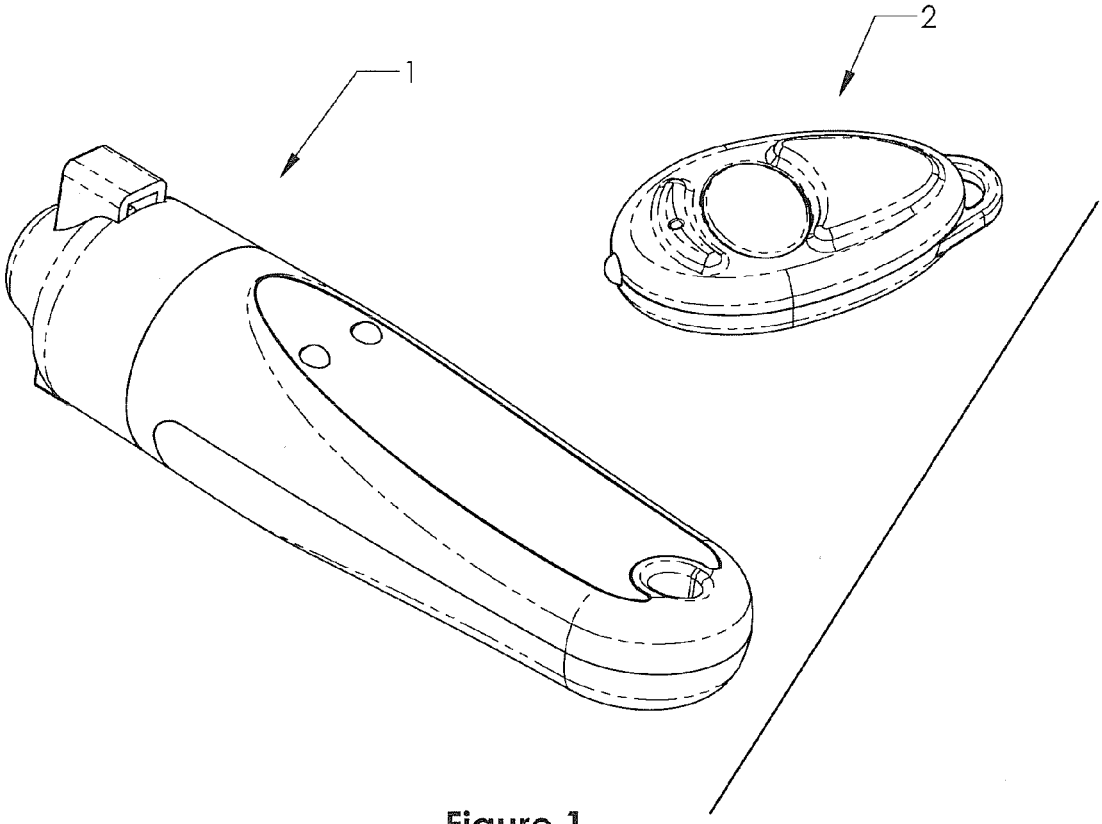
FIG. 1 is a perspective view of the igniter module 1 and the remote control module 2 of the system of this disclosure.
Figure 2:
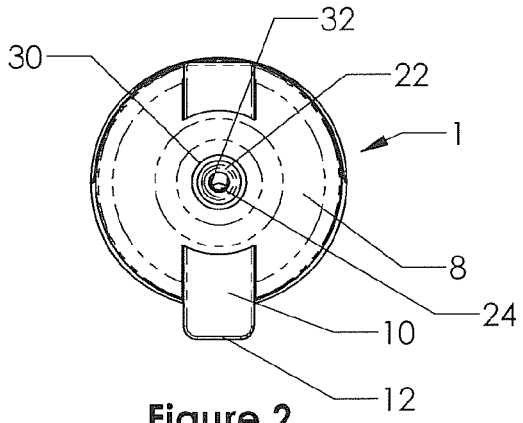
FIG. 2 is an end elevation view of the igniter module 1.

1 igniter module
2 remote control module
3 fuse retainer and igniter head
4 main housing
6 battery cover
8 igniter housing
10 fuse clamp slide
11 clamp slide aperture
12 clamp actuator surface
14 switch manual actuator
16 switch on actuator
18 label
20 support rod aperture
22 thermo insulator sleeve
24 heater element
26 clamp plate
28 clamp plate aperture
30 adhesive gland
32 thermo insulator aperture
34 debris channel
36 clamp spring
38 spring retainer
39 rear spring cavity wall
40 forward stop contact
42 forward stop
44 reverse stop tab
46 reverse stop contact
48 heater support
50 bifurcated contact
52 printed wiring board
54 infrared receivers
56 heater support screw
58 lithium battery
59 battery retainer
60 AA alkaline batteries
62 heater relay
64 microprocessor
66 battery spring clip
68 printed wiring board retainer screw
70 fuse
72 battery cover latch
74 battery cover latch aperture
76 bottle
78 bottle rocket
80 support slot
82 igniter housing support guide
84 infrared light emitting diode
86 remote bottom cover
88 remote top cover
90 switch actuator
92 switch guard
94 lanyard aperture
96 bottom retainer screw
98 remote printed wiring board
99 retainer screw
100 remote active light
102 light aperture
103 infrared light emitting diode driver
104 microcircuit
106 remote switch
108 igniter housing retainer detent
110 main housing retainer slot
112 rear door latch
114 on switch
115 manual switch
116 support rod
118 ground Referring to FIG. 1, the fireworks igniter system includes an igniter module 1 and an remote control module 2. The remote control module 2 may activate the igniter module 1 by a coded infrared signal which ignites a firework fuse at a range of the infrared signal of approximately 30 feet. Igniter module 1 contains a fuse retainer system 3 to clamp fuse securely against the ignition element.

Referring to FIGS. 2, 3, 4, 14, 15, 16, 17, 18, & 19, the igniter module 1 includes a main housing retainer slot 110, battery cover 6, and igniter housing 8. The battery cover 6 provides a mounting for a printed wiring board 52, AA alkaline batteries 60, switch manual actuator 14, switch on actuator 16, battery spring clip 66, igniter housing 8 and label 18. The proximal end of battery cover 6 is retained in the main housing 4 by a battery cover latch 72 detent engaging battery cover latch aperture 74 on main housing 4. The distal end of battery cover 6 is retained by a rear door latch 112 on main housing 4. Igniter housing 8 is retained on main housing 4 by an igniter housing retainer detent 108 engaging main housing retainer slot 110 on main housing 4.

Referring to FIGS. 15, 17, 18 and 19, printed wiring board 52 provides a mounting and electrical connection of two infrared receivers 54, lithium battery 58, heater relay 62, microprocessor 64 and various electrical support components. The infrared receivers 54 are mounted facing 180° apart to provide a 360° infrared signal receiving coverage. Printed wiring board 52 is retained in main housing 4 by printed wiring board retainer screw 68.

The main housing 4 and battery cover 6 are made from a standard temperature-grade plastic. Igniter housing 8 is made from a standard temperature-grade plastic that is infrared-transparent and visible-light translucent. The fuse clamp slide 10 is made from high temperature grade plastic due to the proximity of burning fuses. The main housing 4 and battery cover 6 are made photoluminescent by the addition of photoluminescent materials in the plastic formulation for enhanced visibility at night when fireworks are ignited.

Still referring to FIGS. 12, 15, 17, 18, & 19, the fuse retainer and igniter system 3 may include a thermo insulator 22 attached to igniter housing 8, clamp plate 26 attached to fuse clamp slide 10, and heater element 24. The thermo insulator 22 is made from a high-temperature alumina ceramic material that prevents melting or burning of the plastic igniter housing 8 when heater element 24 is energized. The thermo insulator 22 is attached to igniter housing 8 by an adhesive filled gland 30.

The heater element 24 is made from size 28 American Wiring Gauge nichrome wire formulated from 60% nickel, 16% chromium and 24% iron. Current flow provided by two AA alkaline batteries 60 raises the temperature of the heater element 24 to approximately 975° K. The heater element 24 is contained within a thermo insulator sleeve 22 and is electrically connected to and supported by opposing heater supports 48 fabricated from brass and being affixed to igniter housing 8 by means of heater support screws 56.

Figure 12:
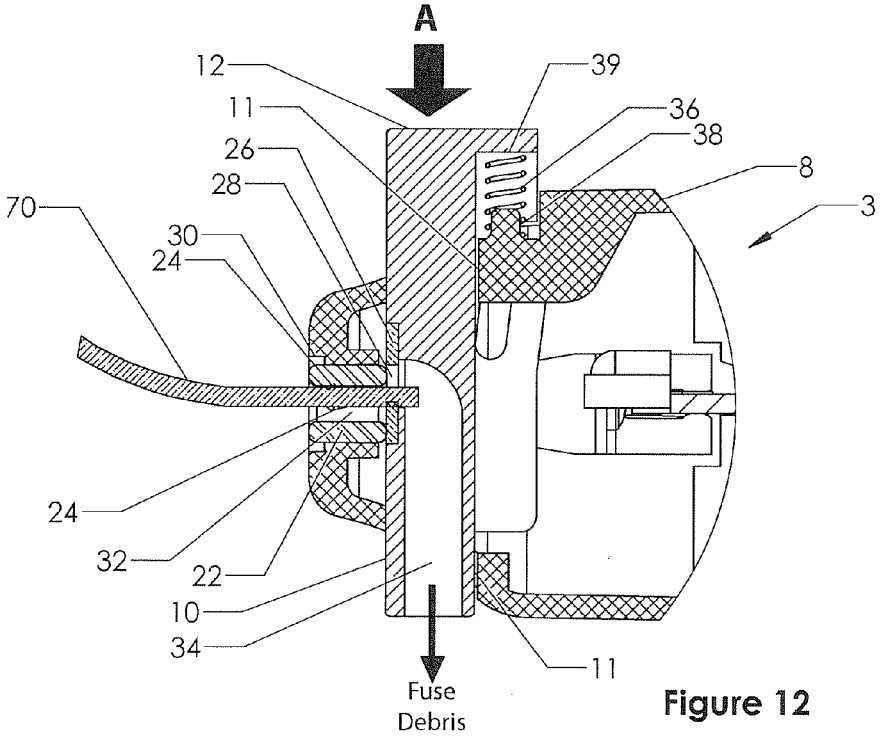
FIG. 12 is an enlarged view of area 12 in FIG. 13.
Figure 14:
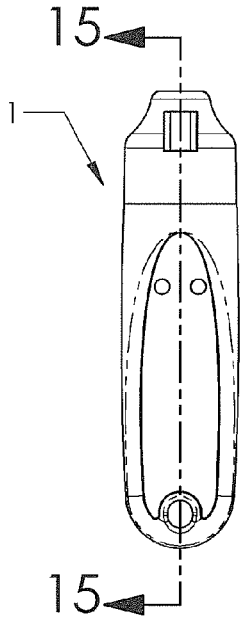
FIG. 14 is a reduced sized view of FIG. 3.
Figure 15:
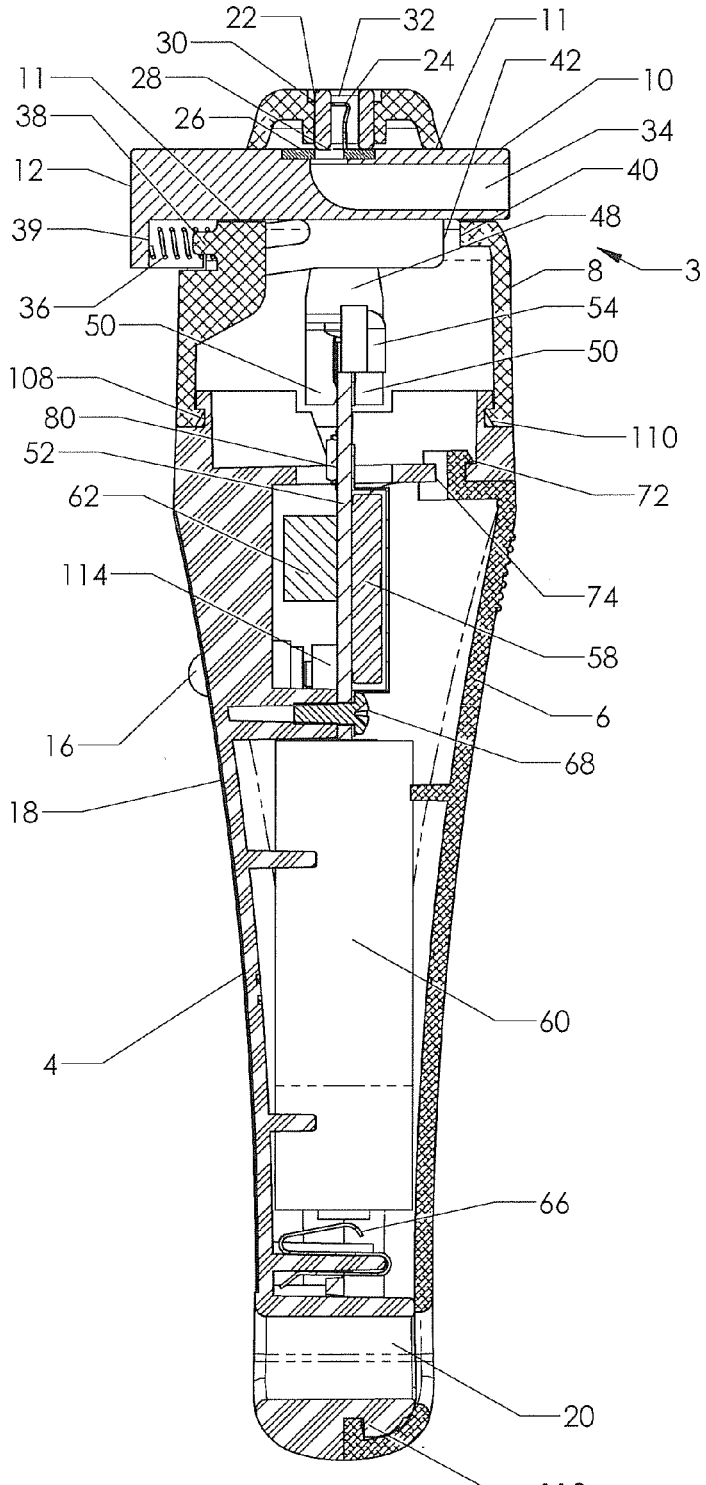
FIG. 15 is a section view in the direction of arrows 15-15 in FIG. 14.
Figure 16:
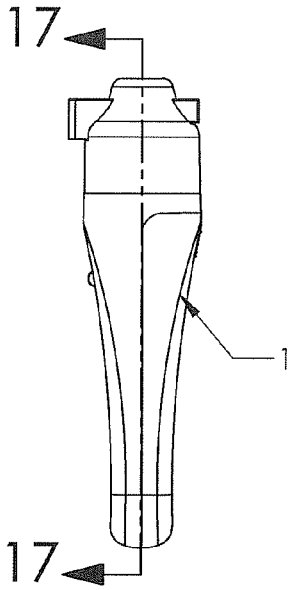
FIG. 16 is a reduced size view of FIG. 4.
Figure 17:
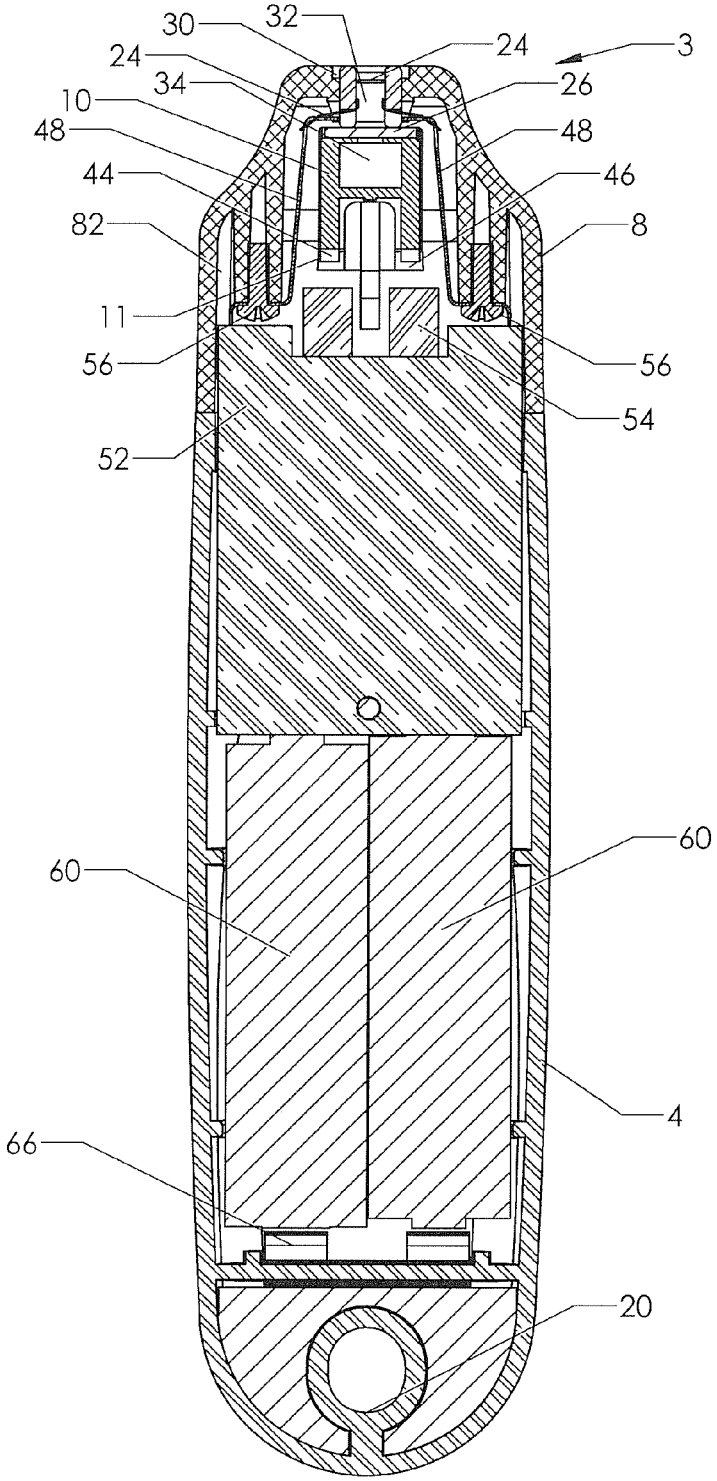
FIG. 17 is a section view in the direction of arrows 17-17 in FIG. 16.
Figure 18:
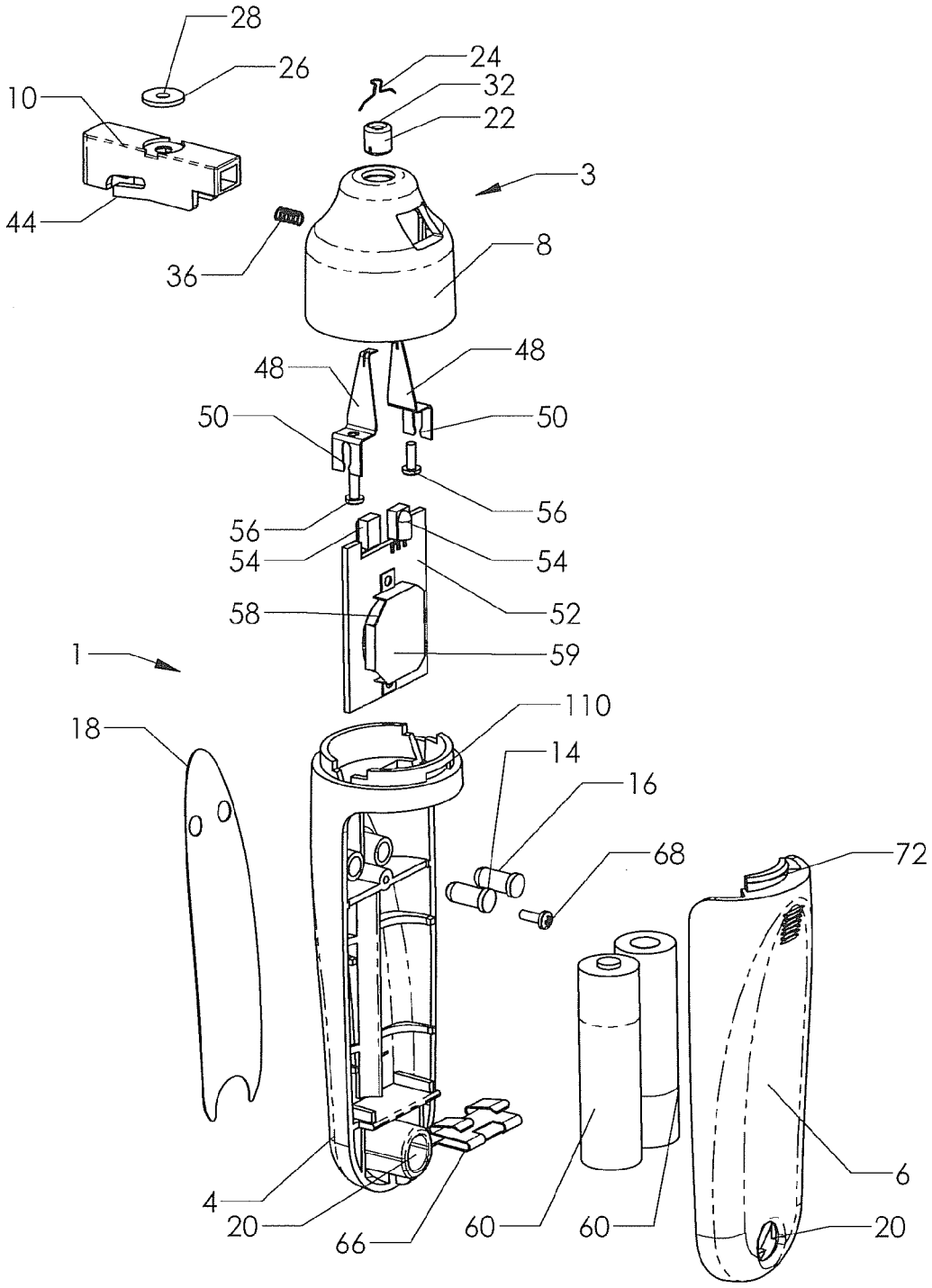
FIG. 18 is an exploded perspective view of the igniter module 1 and fuse retainer and igniter head 3.
Figure 19:
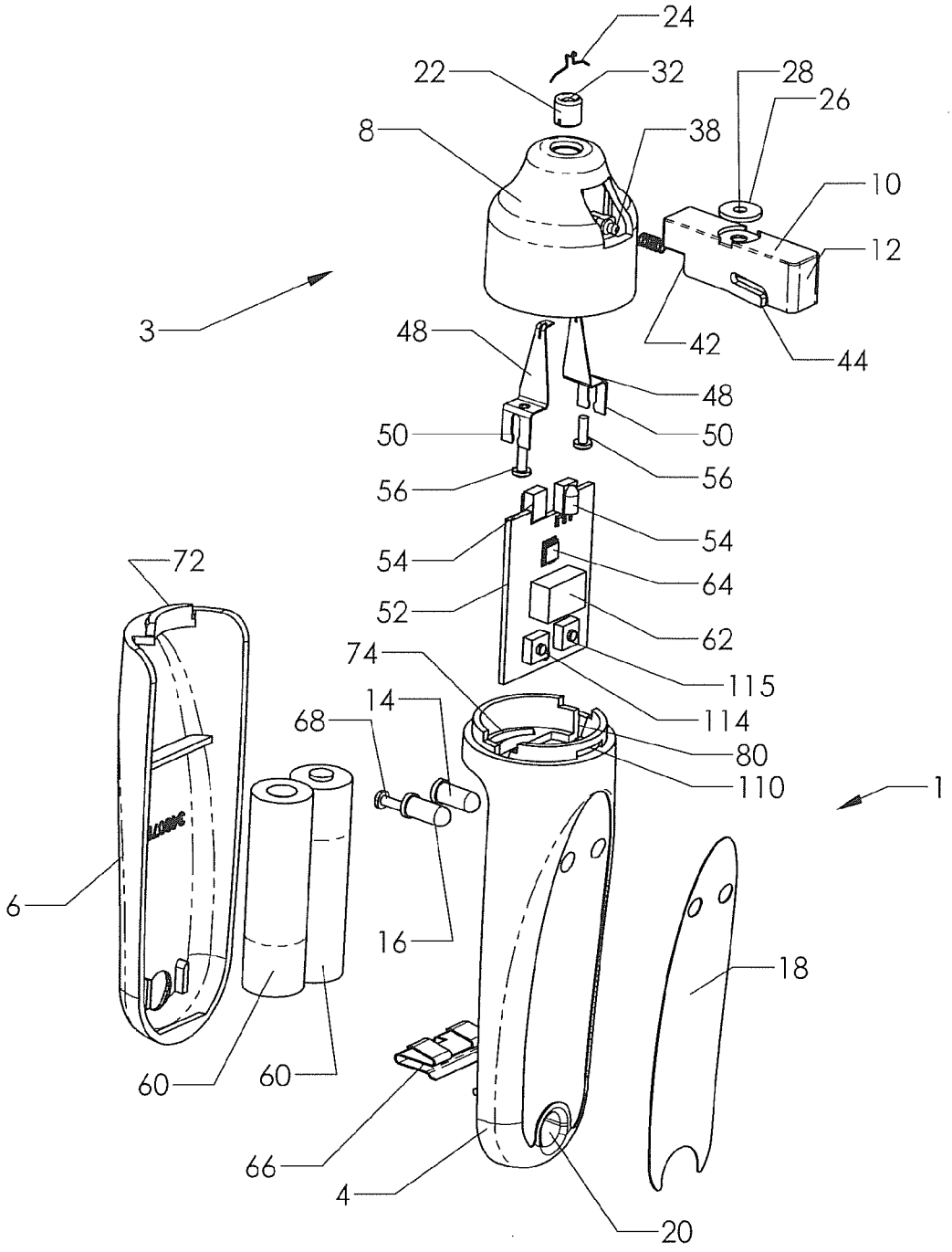
FIG. 19 is another perspective view of FIG. 18.
Figure 20:
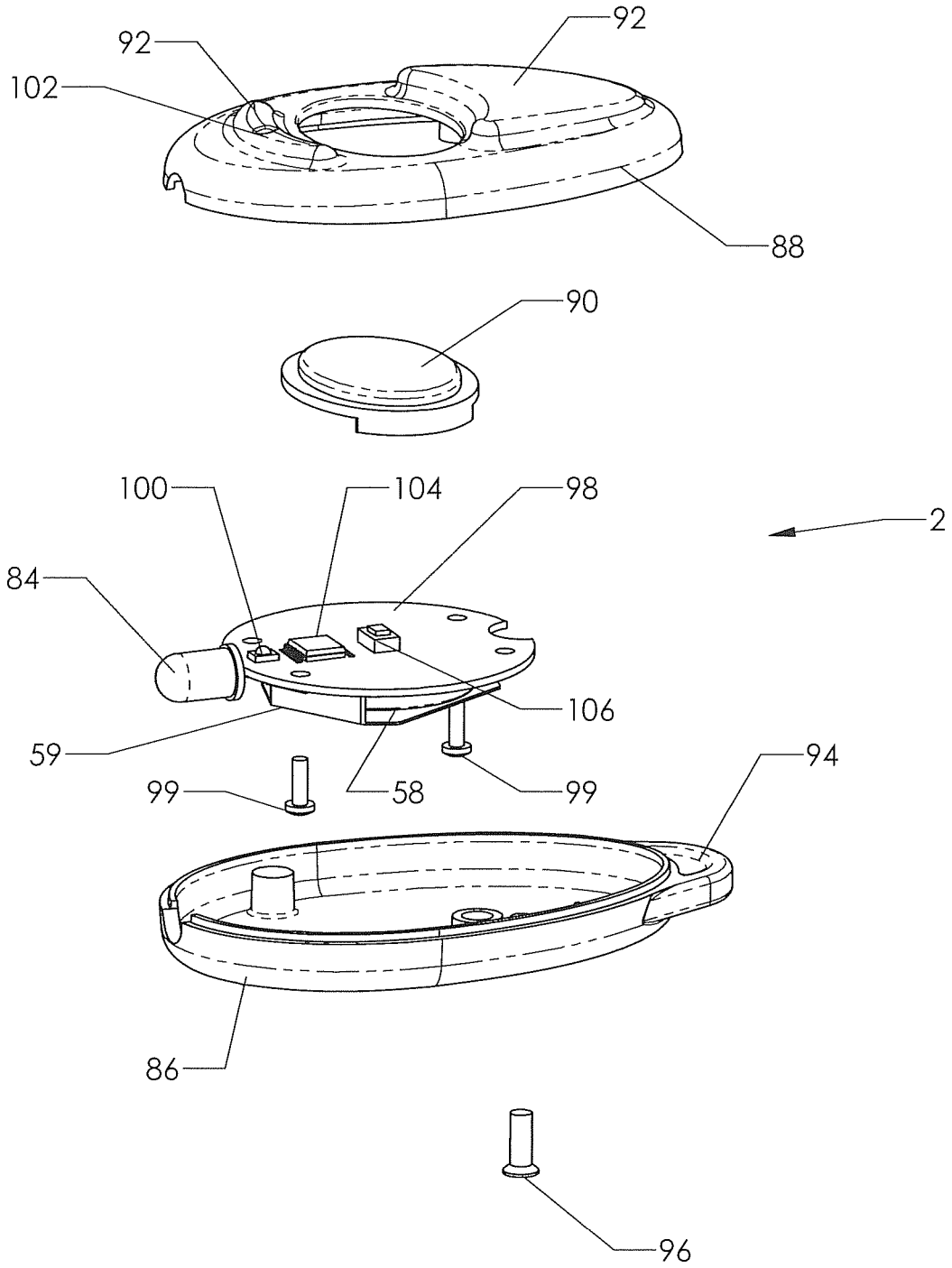
FIG. 20 is an exploded perspective view of the remote control module 2.

To secure a fuse, clamp plate 26 is held in an open position by being slid across the inner surface of thermo insulator sleeve 22 by pushing the fuse clamp slide 10 in the direction of arrow A in FIG. 12. The clamp plate 26 is made from a high-temperature alumina ceramic material due to the proximity of burning fuses. Clamp slide 10 is retained in aperture 11 in igniter housing 8 which allows clamp slide 10 to have lateral freedom of motion through igniter housing 8. Clamp slide 10 is retained laterally by forward stop 42 on its distal end and reverse stop tab 44 on the proximal end. These make contact with forward stop contact 40 and reverse stop contact 46 on igniter housing 8. Clamp spring 36 creates a bias by means of spring retainer 38 on igniter housing 8 and rear spring cavity wall 39 in clamp slide 10. This bias is translated to clamp plate 26.

An electrical connection is made between the heater element 24 and printed wiring board 52 by means of bifurcated contact 50 on heater support 48 connecting to contacts integral to printed wiring board 52. This connects heater relay 62 on printed wiring board 52 in series with two AA alkaline batteries 60 which are connected in series by a conductive battery spring clip 66 held by main housing 4.

Referring to FIGS. 1, 5, 6, 7, 8, 9, 20, & 25, remote control module 2 includes remote bottom cover 86, remote top cover 88, switch actuator 90 and remote printed wiring board 98. Retainer screws 99 secure remote printed wiring board 98 to remote top cover 88. Bottom retainer screw 96 secures remote bottom cover 86 to remote top cover 88. Switch actuator 90 is captured by remote top cover 88 and has freedom of motion to activate remote switch 106 on remote printed wiring board 98. A lithium battery 58, mechanically held and electrically connected to remote printed wiring board 98 by battery retainer 59, powers the circuit. A lanyard aperture 94 is an integral molded feature of remote bottom cover 86.

When remote switch 106 is activated, microcircuit 104 drives infrared light emitting diode 84 with a unique coded signal that is transmitted to igniter module 1. Remote active light 100 illuminates through lamp aperture 102 in remote top cover 88 to confirm to the user that a remote transmission has been sent. To prevent accidental activation of remote control module 2, switch guard 92, an integral part of remote top cover 88, and positioned at a higher elevation than switch actuator 90, prevents depression and activation.

Figure 3:
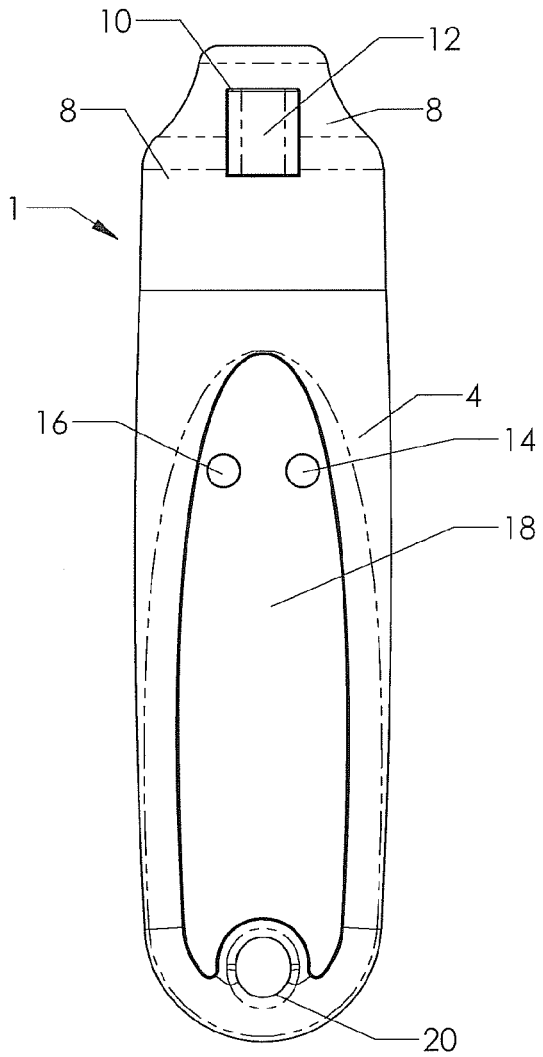
FIG. 3 is a front elevation view of FIG. 1.
Figure 4:
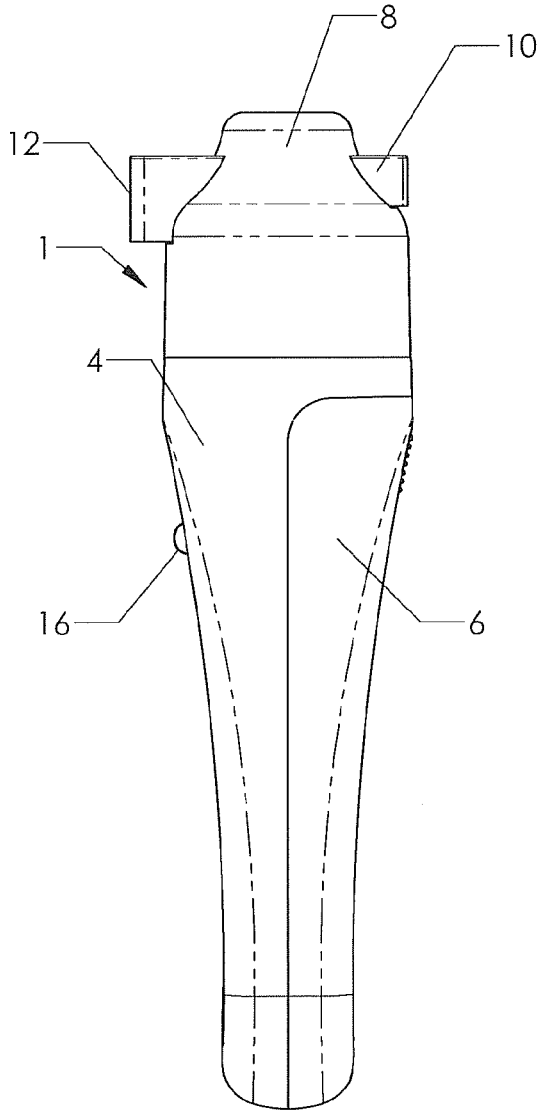
FIG. 4 is a side elevation view of FIG. 3.
Figure 5:
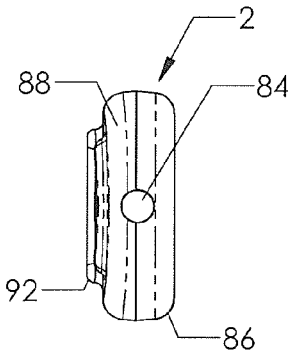
FIG. 5 is an end elevation view of the remote control module 2.
Figure 6:
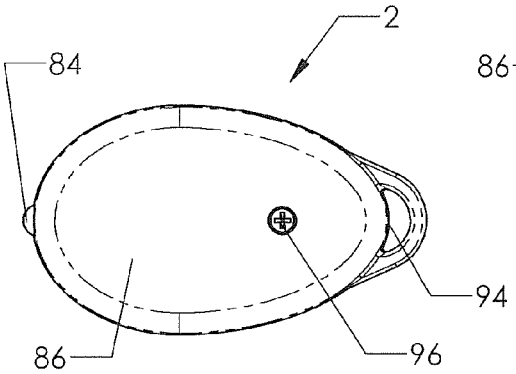
FIG. 6 is a bottom plan view of FIG. 5.
Figure 7:
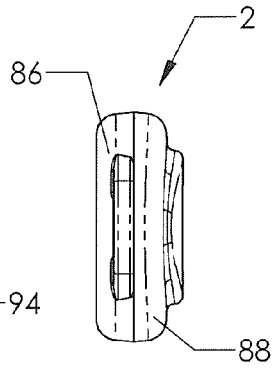
FIG. 7 is another end elevation view of FIG. 6.
Figure 8:
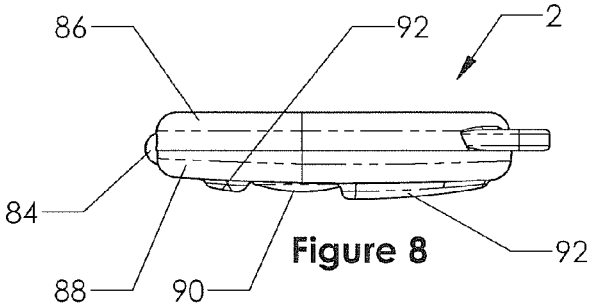
FIG. 8 is a side elevation view of FIG. 6.
Figure 9:
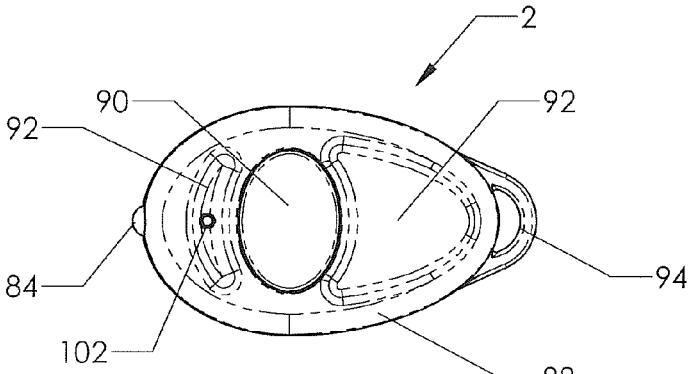
FIG. 9 is a top plan view of FIG. 5.
Figure 10:
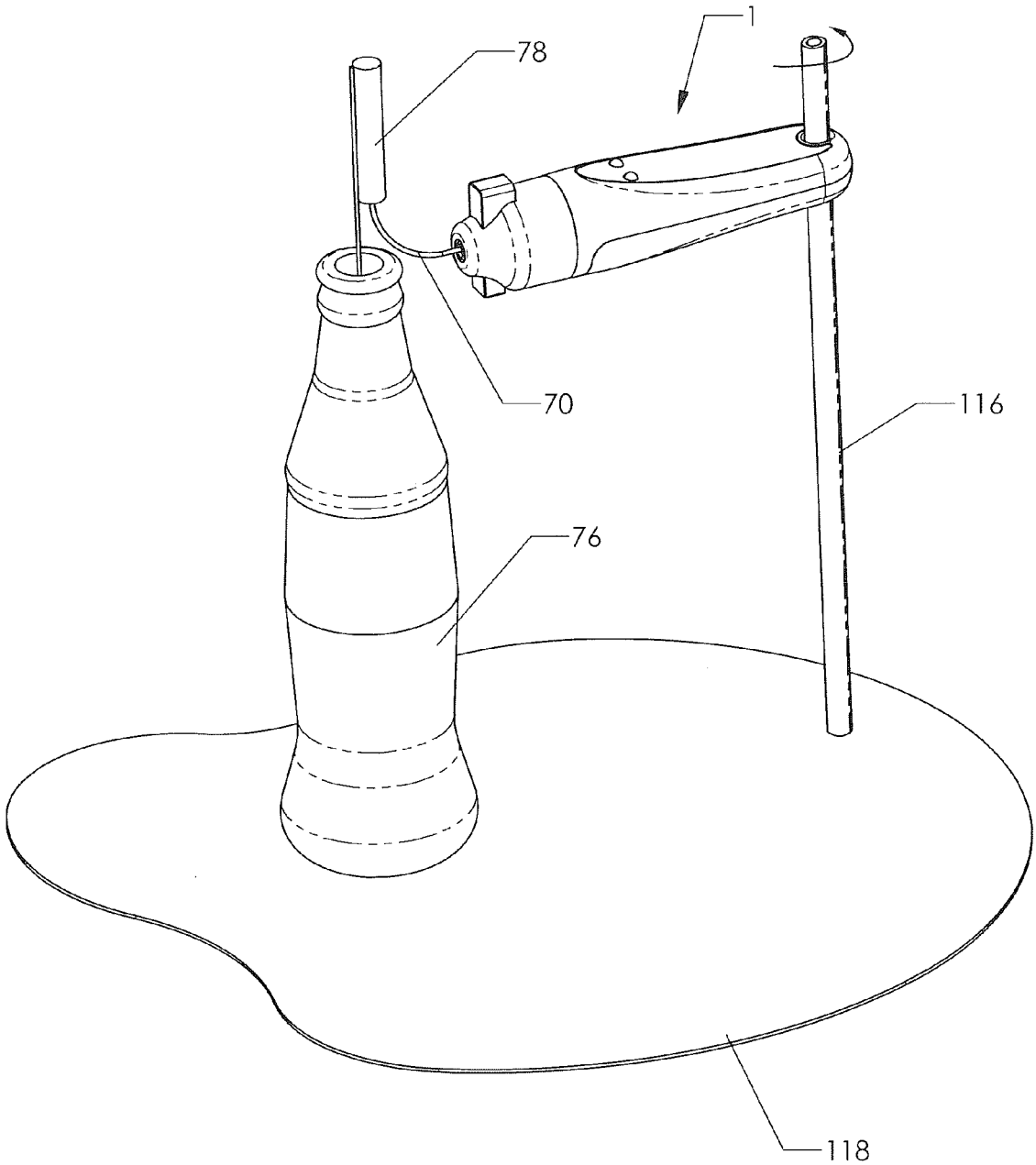
FIG. 10 is a perspective view of a method of using the remote control module 2 to ignite a fuse of a bottle rocket.
Figure 11:
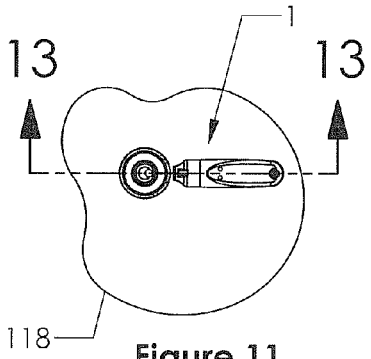
FIG. 11 is a simplified top plan view of FIG. 10.
Figure 13:
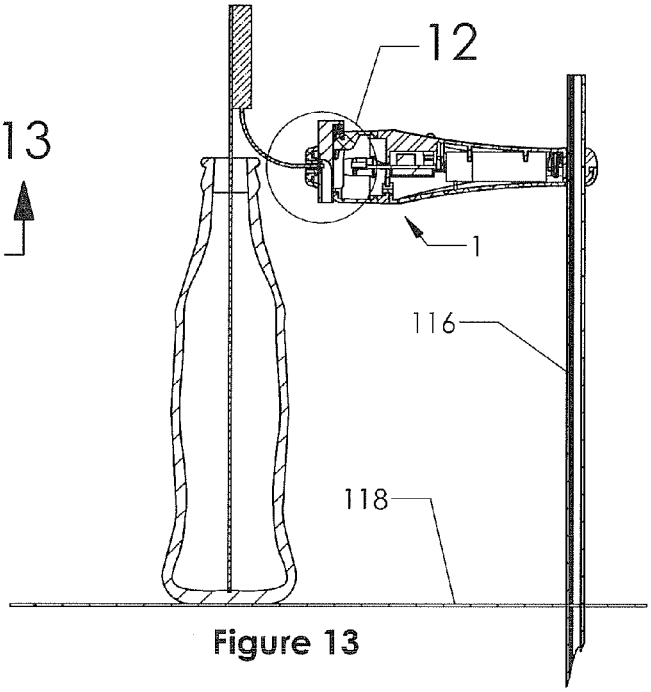
FIG. 13 is a section view in the direction of arrows 13-13 in FIG. 11.
Figure 21:
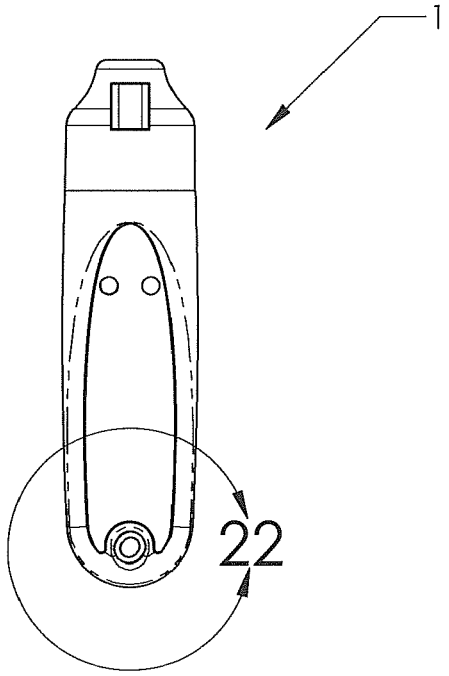
FIG. 21 is a reduced size view of FIG. 3.
Figure 22:
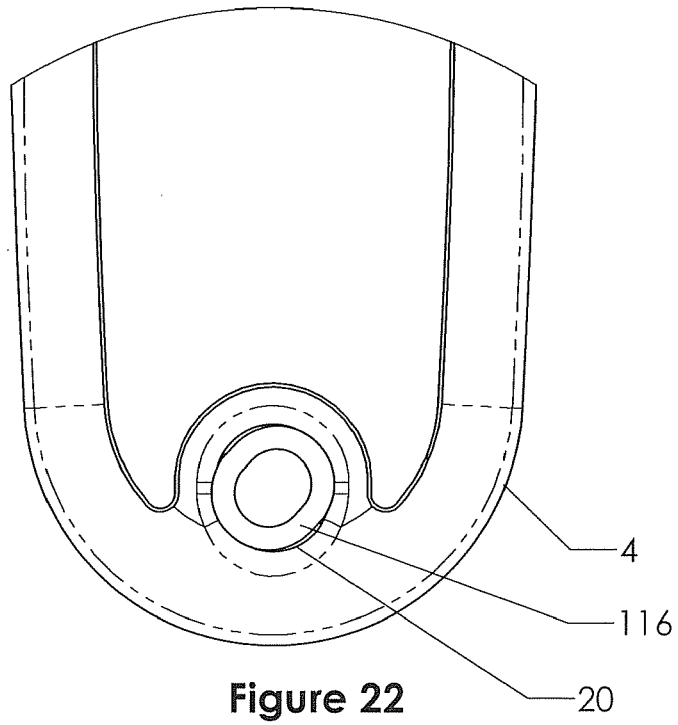
FIG. 22 is an enlarged view of area 22 in FIG. 21.
Figure 23:
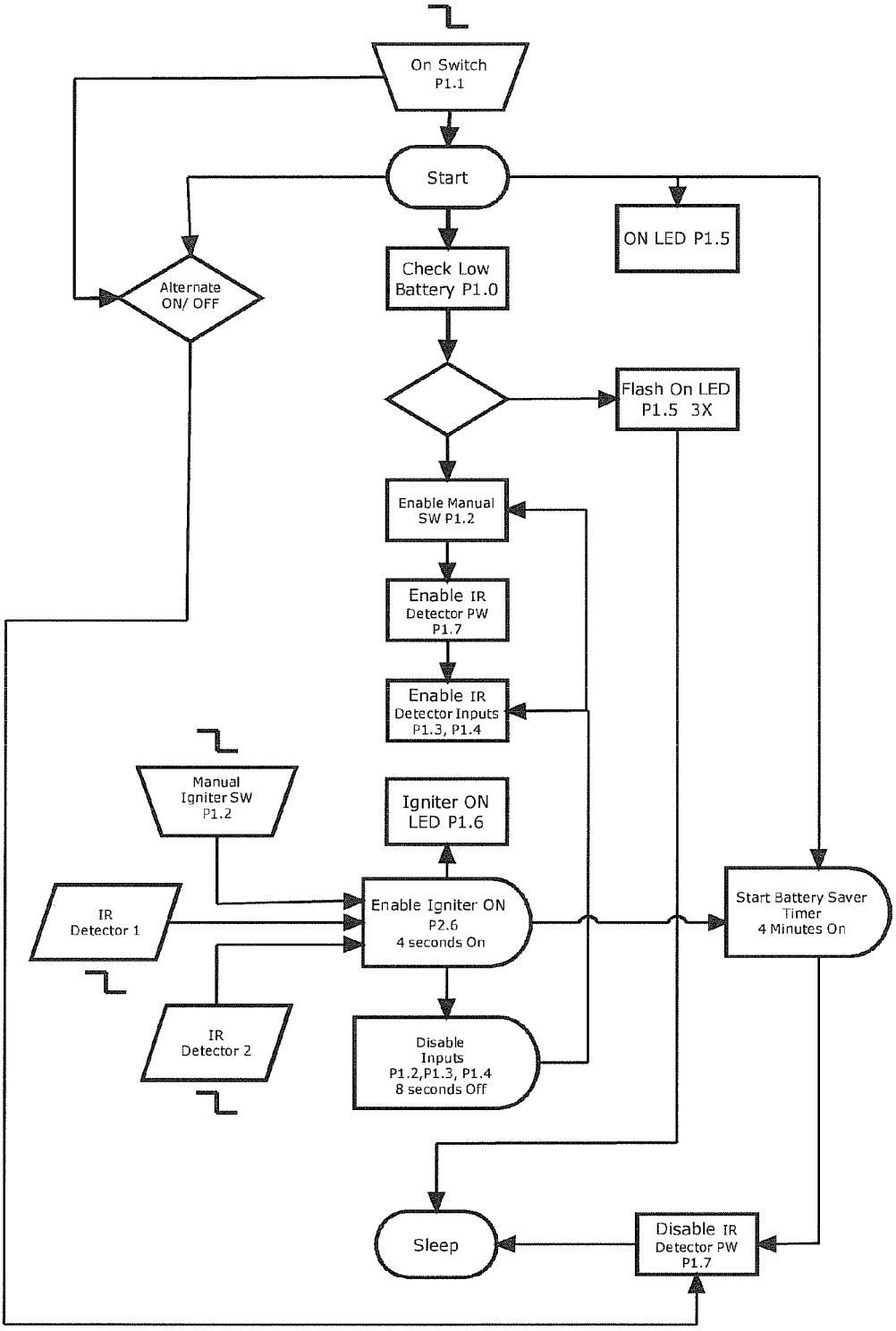
FIG. 23 is an electronic schematic view of the control system of the invention.
Figure 24:
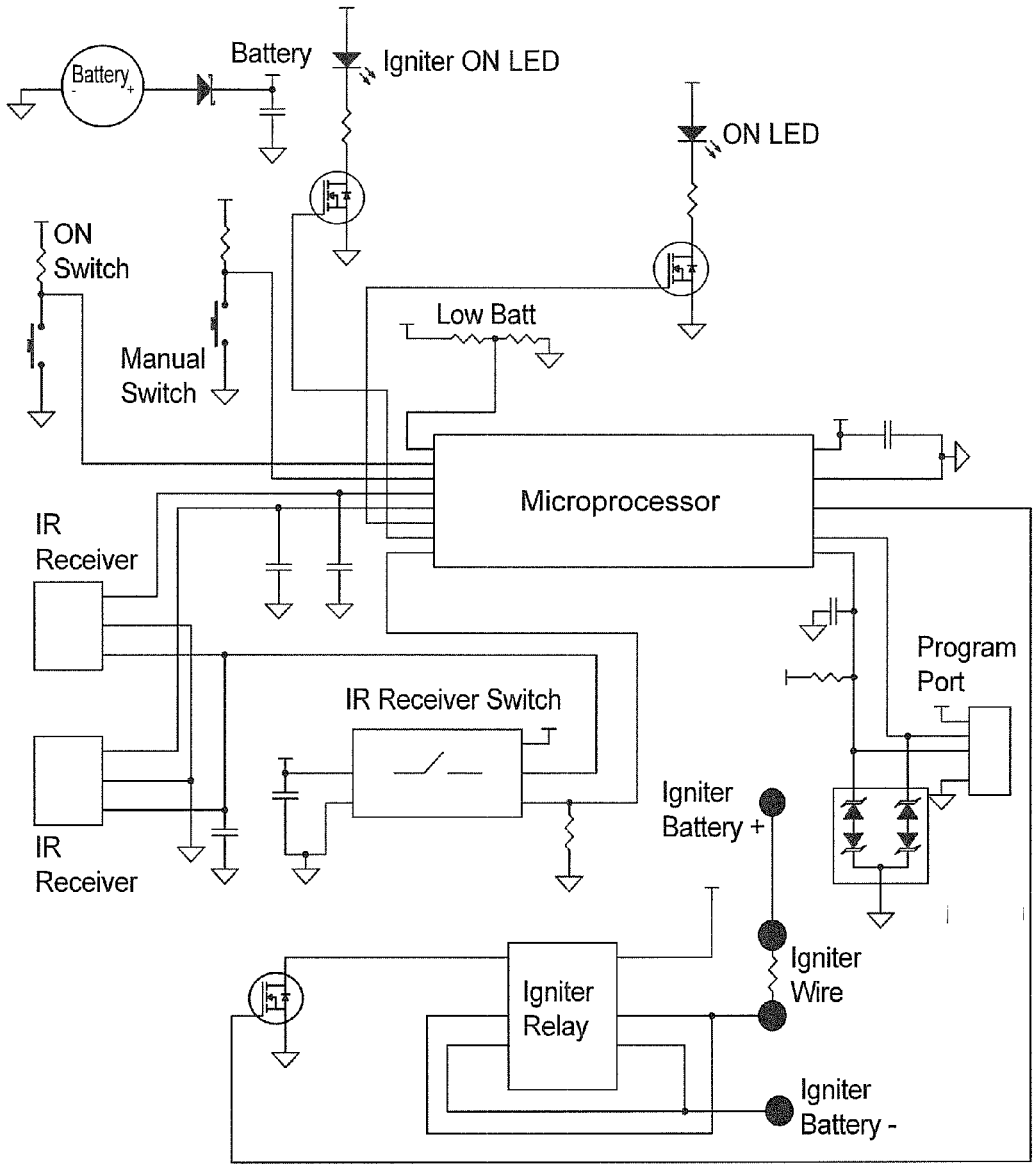
FIG. 24 is an electronic circuit diagram of the microprocessor 64 of the igniter module 1.
Figure 25:
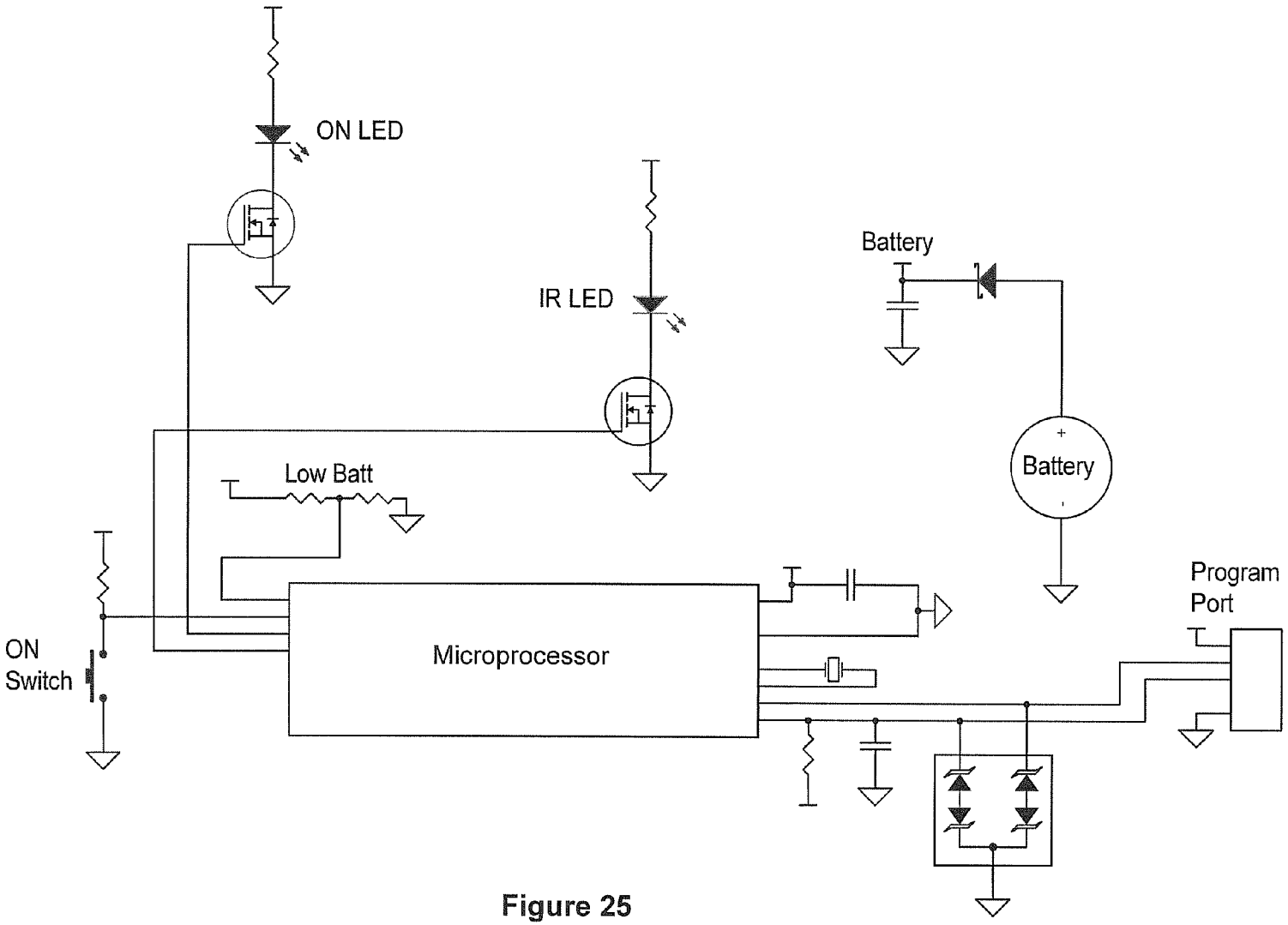
FIG. 25 is an electronic circuit diagram of the remote control module 2.

Referring to FIG. 10, one typical use of this device is there shown wherein the user desires to ignite a bottle rocket 78 from a remote location, typically up to 30 feet away. The user places the bottle rocket 78 in bottle 76 and attaches fuse 70 to the igniter module 1. Due to low fuse retention in some fireworks, the weight of the igniter module 1 is supported by support rod 116 which is pressed into ground 118 and, referring to FIGS. 3, 21, & 22, is inserted into support rod aperture 20 and locked into vertical alignment by twisting the oblong support rod 116 in the oblong support rod aperture 20 in igniter module 1. This twisting action deforms support rod 116 and causes a friction lock with the support rod aperture 20 as required for vertical positioning anywhere along the longitudinal axis of support rod 116. Fireworks that have high fuse retention allow igniter module 1 to be dangled freely in the air supported only by the fuse.

As best seen in FIG. 12, to retain fuse 70 in igniter module 1, thumb pressure is exerted on the clamp actuator surface 12 on clamp slide 10 in the direction of arrow A to align the cylindrical surfaces of thermo insulator aperture 32 and clamp plate aperture 28 of clamp plate 26. Fuse 70 is properly positioned when protruding through insulator aperture 32, clamp plate aperture 28 and into debris channel 34 which extends to one end of the clamp slide 16. As pressure is released from clamp actuator surface 12, the clamp spring 36 biases clamp plate aperture 28 edge against fuse 70. This creates a friction lock to retain fuse 70. After fuse ignition, fuse debris may be cleared from the debris channel 34 by gravity and a shake of the igniter module 1.

Referring to FIGS. 3, 19, 23, 24, pushing switch 14 on actuator 16 in main housing 4 activates switch 114 on printed wiring board 52. Microprocessor 64 is activated and accepts inputs from infrared receivers 54 or manual switch 115. When remote control module 2 is activated and a valid infrared code is detected and sent to microprocessor 64, heater relay 62 is activated to close the circuit path between the AA alkaline batteries 60 and heater element 24. Current flow raises temperature in heater element 24 sufficiently to light the fuse 70 of a firework.

A timer function of microprocessor 64 limits the time the heater element 24 is active to reliably light the fuse 70. This heater element timer 24 prevents overheating of thermo insulator sleeve 22 and melting or burning of plastic igniter housing 8. The timer also increases battery life of AA alkaline batteries 60. At the same time heater element 24 is active, the microprocessor 64 disables the inputs from the infrared receivers 54. After the heater element 24 is inactive, the microprocessor 64 continues to disable infrared receivers 54 input based in an internal time delay until the heater element 24 cools down. The microprocessor 64 disables the heater element 24 through the active and cool-down stages to avoid close proximity infrared energy from the heater element 24 reactivating the highly sensitive infrared receivers 54. A manual switch 115, activated by switch manual actuator 14, overrides the IR control link to allow firework ignition without using remote control module 2. After fuse 70 ignition, the ash from the fuse that was captured in the fuse clamp slide 10 is expelled through the debris channel 34.

While a number of exemplary aspects and embodiments have been discussed above, those of skill in the art will recognize certain modifications, permutations and additions and subcombinations thereof. It is therefore intended that the following appended claims and claims hereinafter introduced are interpreted to include all such modifications, permutations, additions and subcombinations that are within their true spirit and scope.

The invention claimed is:

1. A fireworks igniter system, each of the fireworks having an ignitable fuse, said system comprising:

a handheld igniter module and a handheld remote control module;

said igniter module including an igniter housing and a main housing connected together;

said igniter housing forming a proximal end of said igniter module and including an igniter head with a heater element positioned within a central hole through a thermal insulation sleeve and a fuse clamp slide extending transversely across and being held by said igniter head for limited slidable translation;

said fuse clamp slide including a clamp plate having a fuse aperture formed therethrough in partial alignment with the central hole in said heater element, the central hole and the fuse aperture receiving the fuse inserted therethrough, said fuse clamp slide being biased when at rest against the fuse within the central hole and against said heater element;

said main housing including a microprocessor and a battery power source therein in electrical communication with said microprocessor and said heater element;

said microprocessor including an infrared receiver and an igniter module actuator;

said remote control module housing a microcircuit having an infrared emitter, a remote control module actuator, and a battery power source in electrical communication with said microcircuit, said infrared emitter, and said switch actuator;

said infrared emitter emitting a coded IR signal in response to activation of said remote control module actuator, said IR signal being sensed by said infrared receiver to activate said igniter module actuator and deliver electric current to said heater element sufficient to ignite the fuse.

2. A fireworks igniter system as set forth in claim 1, wherein:

said fuse clamp slide includes a debris channel for dispersing fuse debris after each firework fuse ignition.

3. A fireworks igniter system as set forth in claim 1, said microprocessor further comprising:

a second infrared receiver which, in combination with said infrared receiver, provides a substantially 360° infrared signal receiving coverage.

4. A fireworks igniter system as set forth in claim 3, wherein:

said microprocessor causes a time delay preventing receiving an IR signal from said remote control module for a time period sufficient for said heater element to cool.

5. A fireworks igniter system as set forth in claim 1, wherein:

said cover includes a raised switch guard adjacent to said remote control module actuator for preventing inadvertent or accidental depression of said remote control module actuator.

6. A fireworks igniter system as set forth in claim 1, wherein:

a distal end of said main housing includes a support rod aperture sized to receive and rotatably lockingly engage with an elongated support rod secured at one end thereof whereby said igniter module is holdable stationary on the support rod.

7. A method of safely igniting fireworks having a heat-ignitable fuse comprising:

a. providing a fireworks igniter system including a handheld igniter module and a separate handheld remote control module;

said igniter module including an igniter housing and a main housing connected together;

said igniter housing forming a proximal end of said igniter module and including an igniter head with a heater element positioned within a central hole through a thermal insulation sleeve and a fuse clamp slide extending transversely across and being held by said igniter head for limited slidable translation;

said fuse clamp slide including a clamp plate having a fuse aperture formed therethrough in partial alignment with the central hole in said heater element, the central hole and the fuse aperture receiving the fuse inserted therethrough, said fuse clamp slide being biased when at rest against the fuse within the central hole and against said heater element;

said main housing including a microprocessor and a battery power source therein in electrical communication with said microprocessor and said heater element;

said microprocessor including an infrared receiver and an igniter module actuator;

said remote control module housing a microcircuit having an infrared emitter, a remote control module actuator, and a battery power source in electrical communication with said microcircuit, said infrared emitter, and said switch actuator;

said infrared emitter emitting a coded IR signal in response to activation of said remote control module actuator, said IR signal being sensed by said infrared receiver to activate said igniter module actuator and deliver electric current to said heater element sufficient to ignite the fuse;

b. sliding said fuse clamp slide from the at-rest position;

c. inserting a fuse of a firework into said thermo insulation and against said heater element;

d. releasing said fuse clamp slide to secure the fuse against said heater element;

e. holding said remote control module a safe distance away from the firework;

f. activating said ignition module to receive an IR signal by activating said igniter module actuator;

g. emitting a coded IR signal toward said igniter module whereby the fuse is ignited by said heater element.

8. A fireworks igniter system as set forth in claim 7, wherein:

said fuse clamp slide includes a debris channel for dispersing fuse debris after each firework fuse ignition.

9. A fireworks igniter system as set forth in claim 7, said microprocessor further comprising:

a second infrared receiver which, in combination with said infrared receiver, provides a substantially 360° infrared signal receiving coverage.

10. A fireworks igniter system as set forth in claim 9, wherein:

said microprocessor causes a time delay preventing receiving an IR signal from said remote control module for a time period sufficient for said heater element to cool.

11. A fireworks igniter system as set forth in claim 7, wherein:

said cover includes a raised switch guard adjacent to said remote control module actuator for preventing inadvertent or accidental depression of said remote control module actuator.

12. A fireworks igniter system as set forth in claim 7, wherein:

a distal end of said main housing includes a support rod aperture sized to receive and rotatably lockingly engage with an elongated support rod secured at one end thereof whereby said igniter module is holdable stationary on the support rod.

* * * * *